US008936029B2

(12) United States Patent
Blick et al.

(10) Patent No.: US 8,936,029 B2
(45) Date of Patent: Jan. 20, 2015

(54) PACK FOR TOBACCO INDUSTRY PRODUCTS

(76) Inventors: Kevin Blick, Tokyo (JP); Dennis Lee Potter, Kernersville, NC (US)

( * ) Notice: Subject to any disclaimer, the term of this patent is extended or adjusted under 35 U.S.C. 154(b) by 1182 days.

(21) Appl. No.: 12/864,409

(22) PCT Filed: Feb. 5, 2009

(86) PCT No.: PCT/EP2009/051328
§ 371 (c)(1),
(2), (4) Date: Nov. 29, 2010

(87) PCT Pub. No.: WO2009/092823
PCT Pub. Date: Jul. 30, 2009

(65) Prior Publication Data

US 2011/0120483 A1 May 26, 2011

(30) Foreign Application Priority Data

Jan. 24, 2008 (JP) ..... 2008-014153

(51) Int. Cl.
*A24F 13/00* (2006.01)
*B65D 85/10* (2006.01)

(52) U.S. Cl.
CPC ..... *B65D 85/1081* (2013.01)
USPC ..... 131/329; 206/256; 206/259

(58) Field of Classification Search
USPC ..... 131/329; 206/256, 259
See application file for complete search history.

(56) References Cited

U.S. PATENT DOCUMENTS

| | | | | |
|---|---|---|---|---|
| 1,972,118 | A | 9/1934 | McDill | |
| 2,007,632 | A | 8/1935 | Blank et al. | |
| 4,487,801 | A | 12/1984 | Turnbull | |
| 4,717,017 | A | 1/1988 | Sprinkel, Jr. et al. | |
| 4,720,423 | A | 1/1988 | Fraser | |
| 4,923,059 | A | 5/1990 | Evers | |
| 4,934,524 | A | 6/1990 | St. Charles | |
| 4,990,345 | A | 2/1991 | Webb | |
| 5,035,731 | A | 7/1991 | Spruill et al. | |
| 5,037,459 | A * | 8/1991 | Spruill et al. | 96/118 |
| 5,724,997 | A | 3/1998 | Smith et al. | |

(Continued)

FOREIGN PATENT DOCUMENTS

| | | | |
|---|---|---|---|
| FR | 2864428 | A | 7/2005 |
| FR | 2864428 | A1 | 7/2005 |

(Continued)

OTHER PUBLICATIONS

Patent Examination Report No. 1, dated Sep. 10, 2012, for Australian Patent Application No. 2009207584, filed Feb. 5, 2009.

(Continued)

*Primary Examiner* — Richard Crispino
*Assistant Examiner* — Dionne Walls Mayes
(74) *Attorney, Agent, or Firm* — N W Poulsen; L A Pinol

(57) ABSTRACT

A pack (1) for tobacco industry products, comprises a housing defining an enclosure in which a plurality of tobacco industry products (4) can be accommodated, and a capsule (10) containing a substance such as flavoring substance, disposed in or on the pack, arranged to be opened manually such that, when opened, flavoring substance is released from the capsule and absorbed by tobacco industry products disposed in the pack, to refresh their flavor.

18 Claims, 5 Drawing Sheets

(56) References Cited

U.S. PATENT DOCUMENTS

| | | | | |
|---|---|---|---|---|
| 5,938,012 | A | 8/1999 | Yeager et al. | |
| 5,997,178 | A | 12/1999 | Nye et al. | |
| 6,041,790 | A | 3/2000 | Smith et al. | |
| 6,164,444 | A | 12/2000 | Bray et al. | |
| 6,237,760 | B1 | 5/2001 | Parker et al. | |
| 6,612,429 | B2 | 9/2003 | Dennen et al. | |
| 6,658,822 | B1 * | 12/2003 | Dittrich | 53/474 |
| 6,929,120 | B2 | 8/2005 | Zonker et al. | |
| 7,004,313 | B2 | 2/2006 | Mitchell et al. | |
| 7,226,613 | B2 | 6/2007 | Schleifenbaum et al. | |
| 7,841,586 | B1 * | 11/2010 | Mongeon et al. | 261/104 |
| 2002/0195355 | A1 | 12/2002 | Dennen | |
| 2006/0278543 | A1 | 12/2006 | Pham | |
| 2007/0193892 | A1 | 8/2007 | Tanbo et al. | |
| 2007/0193896 | A1 | 8/2007 | Tanbo et al. | |

FOREIGN PATENT DOCUMENTS

| | | | |
|---|---|---|---|
| JP | 60100696 | A | 6/1985 |
| JP | 6368878 | A | 3/1988 |
| JP | 63248674 | A | 10/1988 |
| JP | 8-228751 | A | 9/1996 |
| JP | 9-187266 | A | 7/1997 |
| JP | 2000152981 | A | 6/2000 |
| JP | 2001504069 | A | 3/2001 |
| JP | 200327395 | A | 1/2003 |
| JP | 2005516584 | A | 6/2005 |
| WO | 98/22367 | A1 | 5/1998 |
| WO | 03000571 | A1 | 1/2003 |

OTHER PUBLICATIONS

Notice of Acceptance, dated Dec. 3, 2012, for Australian Patent Application No. 2009207584, filed Feb. 5, 2009.

International Search Report and Written Opinion corresponding to PCT/EP2009/051328 mailed May 11, 2009.

International Preliminary Report on Patentability corresponding to PCT/EP2009/051328 mailed Mar. 3, 2010.

English translation of Japanese Office Action, mailed Oct. 16, 2012, for JP Patent Application No. 2008-014153.

* cited by examiner

PACK FOR TOBACCO INDUSTRY PRODUCTS

CLAIM FOR PRIORITY

This application is a National Stage Entry entitled to and hereby claims priority under 35 U.S.C. §§365 and 371 corresponding to PCT Application No. PCT/EP2009/051328, filed Feb. 5, 2009, which in turn claims priority to Japanese Application Serial No. JP 2008-014153, filed Jan. 24, 2008, all of which are hereby incorporated by reference.

FIELD OF THE INVENTION

The present invention relates to a pack for tobacco industry products adapted to release a substance, for example to refresh or enhance the substance in the products. In particular, but not exclusively, the present invention relates to a pack for flavoured tobacco industry products such as menthol-flavoured cigarettes for refreshing or enhancing the menthol flavouring of the cigarettes.

BACKGROUND

The present invention is described herein with reference to "tobacco industry products" or "products". A tobacco industry product as referred to herein is any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn products; and c) smoking cessation aids and other nicotine-delivery systems such as adhesive patches, inhalers, lozenges and gum. This list is not intended to be exclusive, but merely illustrates a range of products which are made and sold in the tobacco industry.

Menthol-flavoured cigarettes are well-known in the art and comprise a tobacco-based cigarette to which menthol flavouring is added. When consumed, the user experiences the taste of menthol.

Cigarettes are contained and sold to consumers in cigarette packs which are typically sealed during manufacture to maintain the freshness of the product contained therein. However, once the pack is opened, the product's freshness deteriorates over time. The tobacco of the cigarettes may become undesirably dry once the pack is opened. Also, the cigarettes may be provided with a flavourant during manufacture, such as menthol, and over time, the menthol flavouring may escape from the product in an opened pack with the result that the consumer experiences menthol levels which are below those prescribed by those prescribed by the manufacturer. Eventually, the menthol flavouring of products contained in the opened pack can be lost to an extent where the article becomes undesirable to the consumer.

The present invention aims to provide a pack which can refresh, enhance or replenish substances into a tobacco industry product such as a cigarette contained in for example an opened pack, such as a flavourant.

SUMMARY OF THE INVENTION

The invention provides a pack for tobacco industry products, comprising an operable housing defining an enclosure in which a plurality of tobacco industry products can be accommodated, and a carrier disposed in or on the pack, said carrier being arranged to accommodate a substance for altering characteristics of the tobacco industry products when in the pack; wherein said carrier is arranged to be opened manually such that, in an open state, the substance released from the carrier is at least partially absorbed by tobacco industry products when disposed in the pack.

Thus, additional substances such as flavouring substances can be incorporated into the pack for absorption by tobacco industry products disposed therein to replenish or enhance them for the time when the article is to be consumed.

Advantageously, the carrier can be in liquid communication with the enclosure by means of a wick. Thus, the substance can comprise a liquid for ease of storage. Furthermore, the wick can efficiently direct the substance to an appropriate portion of the pack.

Advantageously, the wick can comprise a portion of the housing. Thus, the wick is incorporated into the housing to minimise an increase of the number of components needed during manufacture.

Advantageously, the wick can be arranged to direct to the substance released from the carrier to a predetermined portion of the enclosure. Thus, substance can be delivered to a desired portion of the pack, and hence articles disposed therein. For instance, when cigarettes contained in the pack are filter tipped, the predetermined portion of the enclosure to which substance is to be delivered can be disposed distal from the end of the cigarettes' filters. As a result, contamination of the filters by the substance can be reduced or eliminated.

The carrier may comprise a rupturable capsule and advantageously, the housing can comprise an indentation to accommodate the capsule. The indentation can have a depth which is equal to a dimension of the capsule. Thus, the capsule can be accommodated by the pack or housing without protruding therefrom. In addition, the capsule can be attached to the pack by an adhesive or label to securely maintain the capsule in a desired position. The label can be arranged to reduce the rate at which flavouring substances escape from the pack.

Advantageously, a plurality of capsules can be disposed in a lid portion of the pack. Thus, the capsules are easily accessible by a consumer. Furthermore, the plurality of capsules can be accessible when the lid is in an open position to allow a tobacco industry product to be removed from the pack. In the way, the capsules are inaccessible when the lid is closed, and thus a degree of protection is provided against inadvertent capsule breakages.

Advantageously, bursting means can be provided which is arranged to burst the capsule for release of the substance therefrom when pressure is manually applied to the bursting means.

The bursting means can comprise a rod or pin slideably disposed in a channel, the rod or pin being moveable between a first position disengaged from the capsule and a bursting position. Thus, an arrangement for relatively easy bursting of the capsule is provided Advantageously, the bursting means can comprise two moveable rods spaced apart from each other and arranged to burst a capsule disposed therebetween when the rods are moved towards one another. This arrangement provides an alternative capsule bursting arrangement.

Advantageously, the bursting means can comprise an elongate strip of material, one end of which is accessible by a user and a portion of the strip is in contact with the capsule, said strip being moveable such that the capsule is broken as the strips moves from a first to a second position. Thus, when the strip of material is pulled by a user, the capsule is burst. This arrangement provides a further alternative, relatively easy capsule bursting arrangement.

Advantageously the pack according to the present invention can comprise an outer shell and an inner frame having the carrier is disposed therebetween. Thus, the carrier is accommodated within the housing, thereby providing an arrangement where the carrier can be securely housed.

Advantageously, the inner frame is permeable to the substance accommodated in the carrier. Thus, the inner frame can act as a wick for the flavouring substance, thereby providing means to transport efficiently the substance from the carrier to the enclosure accommodating tobacco industry products.

Advantageously, channels can formed between the outer shell and inner frame to direct the substance from the capsule. This arrangement can be used to better direct substances from the carrier, for efficient delivery to a predetermined location in the pack. The channels can be formed from de-bossed sections of the inner frame or outer shell. Furthermore, the channels can be formed on respective surfaces of the inner frame or outer shell which face one another.

The substance accommodated in the carrier may comprise a flavouring substance, for example menthol, or a substance to refresh dry and stale products without additional flavouring thereof, for example water.

BRIEF DESCRIPTION OF THE DRAWINGS

Embodiments of the present invention are now described, by way of example, with reference to the accompanying drawings, of which:

FIG. 2 is a schematic diagram of the pack shown in figure, wherein

FIG. 5 is a schematic diagram of another alternative embodiment of the pack, wherein

Figure 1:
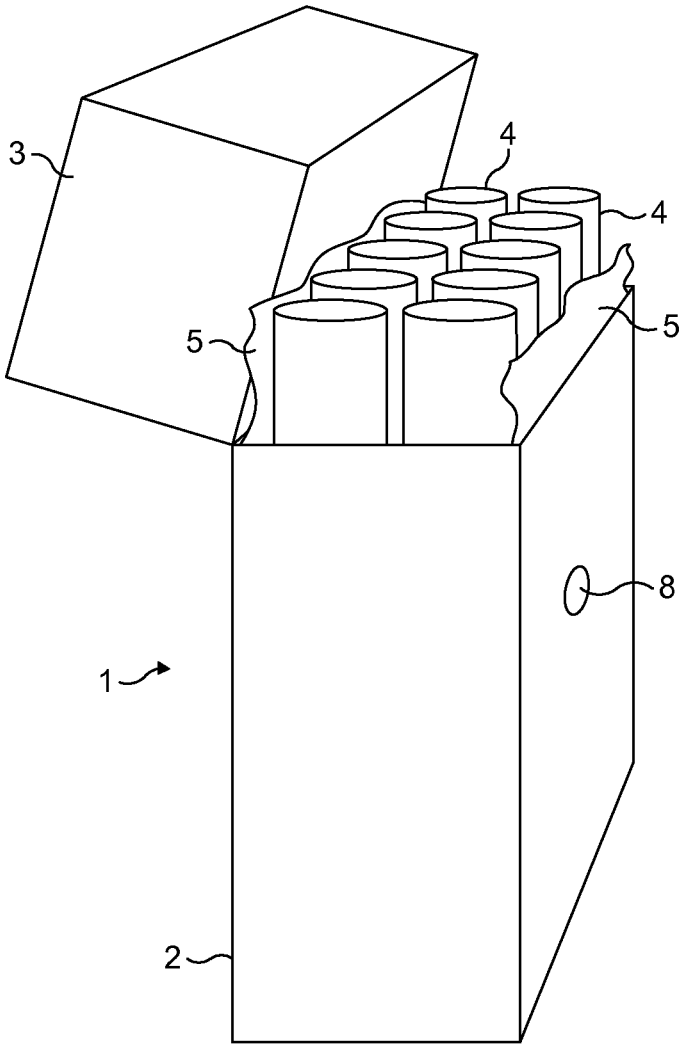
FIG. 1 is a schematic diagram of a pack for tobacco industry products such as cigarettes.

A tobacco industry product pack 1 is shown in FIG. 1 in schematic form. The pack 1 comprises a main body 2 and a hinged lid 3 attached to the main body. The pack is opened by moving the lid from a closed to an open position to expose tobacco industry products 4 disposed within an enclosure defined by the interior dimensions of the main body of the pack 2 and the lid 3. Typically, the tobacco industry products 4 are packed in a foiled paper wrapper 5 disposed within the pack 1 to maintain a degree of freshness of the tobacco industry products.

The pack further comprises a refreshing device 8 by which the freshness of articles contained in the pack can be refreshed or enhanced. As discussed previously, tobacco industry products are known to dry out once a pack is opened, particularly over long periods of time. As a result, the products contained in the opened pack can become stale. In the case of flavoured tobacco industry products, such as menthol cigarettes, the level of menthol flavour available to the consumer degrades over time to a level which is unacceptable. Thus, the refreshing device provides a device for reintroducing substances into the pack which increase the level of the substance in the tobacco of the tobacco industry products in the pack. The substance may comprise a humectant such as water or a flavouring substance to augment the levels thereof in the product contained in the pack above a threshold of consumer acceptance.

Figure 2A:
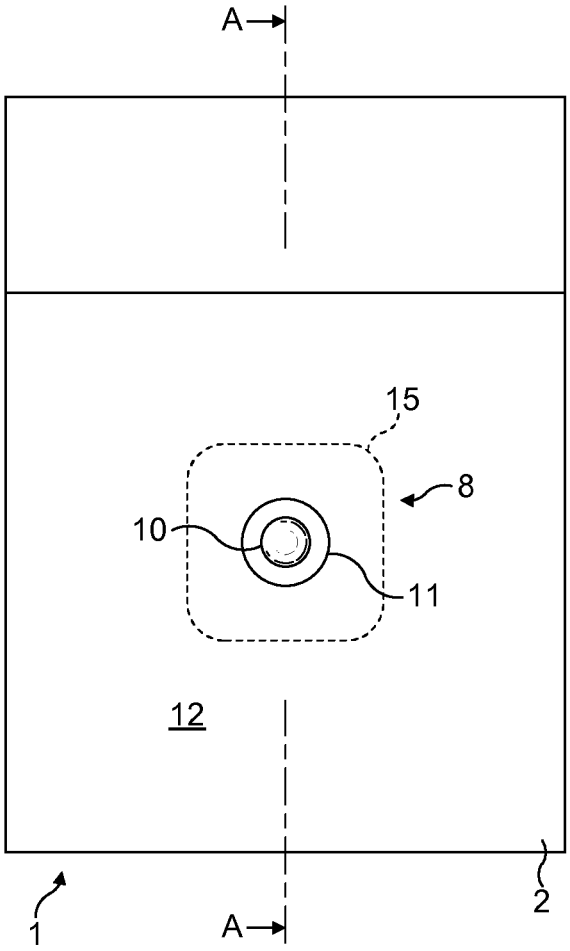
FIG. 2A is a front view of the pack and FIG. 2B is a cross-sectional view of the pack.

FIG. 2 shows the pack of FIG. 1 in more detail. FIG. 2A illustrates the pack 1, having the refreshing device 8 disposed on the main body 2 of the pack. The refreshing device 8 comprises a carrier 10 that accommodates a flavouring substance or refreshing substance in a liquid form. The carrier 10 is in the form of a rupturable capsule 10 that is arranged to be burst by the application of pressure applied manually to the capsule. In the embodiments shown in FIG. 2A, the capsule 10 is disposed in an indentation 11 formed in the front face 12 of the pack.

Figure 2B:
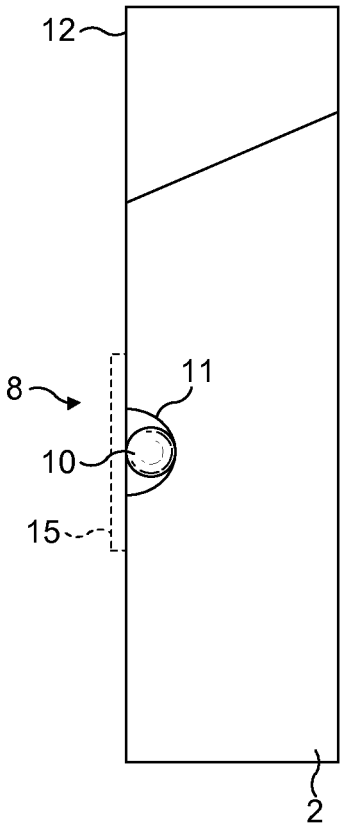

FIG. 2B shows the cross-section of the pack shown in FIG. 2A, along line AA. Here, it can be seen that the capsule 10 is disposed in an indentation having similar dimensions to the diameter of the capsule so that the capsule remains generally flush with the front face 12 of the pack 1. In addition, a covering member 15 can be disposed over the capsule accommodated in the indentation 11. The covering member is arranged to maintain or hold the capsule in the indentation. Furthermore, when the capsule is in an open state (that is, when the capsule is burst) the covering member 15 is arranged to be impermeable to the liquid disposed in the capsule. Thus, the liquid is initially contained between the covering member 15 and the indentation 11. In the following example, the capsule 10 contains a flavouring substance also referred to as a flavourant, for example menthol although it will be appreciated that other liquids could be used including water for the purpose of boosting the water content of the tobacco.

The material of the pack, particularly the material at and around the indentation 11 where the capsule is disposed, can be made from permeable material so that flavouring liquid released from the capsule is absorbed by the pack material at the point of the indentation. The absorbent portion of the pack acts as a wick, which can be arranged to direct liquid to a desired location in the pack. Printing or other pre-treatment of the pack's material can provide wicking patterns to distribute the flavour liquid evenly throughout the pack. In addition, the pre-treatment could be arranged to provide a visual representation of the liquid's distribution once the capsule is crushed.

Typically, tobacco industry product packets are made from card having a printed finish. The printed finish is disposed on the exterior surface of the pack and is usually relatively impermeable to liquid to prevent moisture from escaping the package, which would result in the pack's contents becoming dry and stale. As a result, the indentation can be formed of a portion of package which has not been printed and therefore remains permeable to moisture. In this instance, the covering member 15 acts to prevent excessive loss of humidity or water from the package, via the indentation, to atmosphere. The combination of the unprinted, permeable, indentation and the impermeable sealing member should not contribute to acceleration of the product's deterioration whilst it being is stored for sale. Furthermore, the covering member 15 can provide a seamless look to the product pack.

Figure 3:
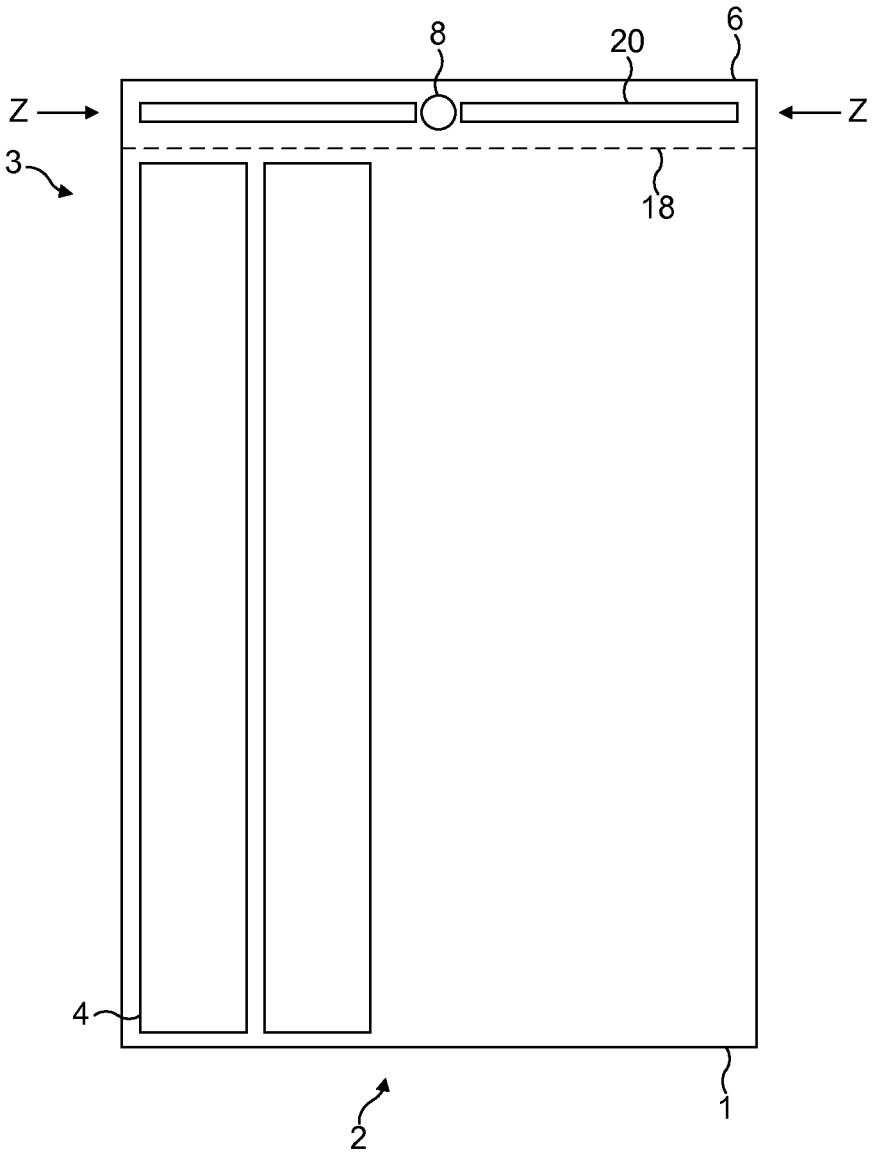
FIG. 3 is a schematic cross-sectional view of an alternative embodiment of the pack.

FIG. 3 illustrates a second embodiment of the present invention where the capsule is disposed in a lid portion 3 of the pack 1. In this embodiment, the capsule is disposed centrally at the top of the lid portion between the top surface of the lid 6 and an inner wall 18. Disposed either side of the capsule are provided a mechanism to crush or pierce the capsule. In this embodiment, two rods 20 are provided, which are moveable within a space between the top surface 6 of the lid 3 and the inner surface 18, as indicated by arrow Z in FIG. 3. Thus, the user is able to pinch appropriate portions of the lid together so that the rods crush and break the capsule 8.

The liquid escaping from the crushed capsule can be absorbed by the material comprising the inner wall 18 of the lid. Again, the inner wall 18 is acting as a wick for the flavouring substances.

The inner wall 18 can be formed into a channel to accommodate the capsule and rods for crushing the capsule. In addition, several crushing arrangements and capsules can be arranged alongside one another so that two or more capsules can be disposed in the lid for releasing flavouring liquid at different occasions after the pack has been opened.

The rods can be provided with sharpened tips or pins closest to the capsule so that the capsule's outer skin is pierced by the action of the rods being pinched together. Alternatively, the capsule can be accommodated in a close-ended channel. In this arrangement, only a single rod or pin is required because manually applied pressure on the rod causes the capsule to be crushed between the end of the rod and the closed end of the channel.

In an alternative arrangement, the capsule can be wrapped in an appropriate strip of material, the distal end of which is accessible by a user. When the distal end is pulled from the pack by the user, the material unwraps against the capsule's surface, tearing the capsule surface to release the flavouring substance accommodated therein. A portion of the strip in contact with the capsule can be made of abrasive material to enhance the reliability of bursting a capsule. Alternatively, the material can be arranged to act as a tourniquet such that, when the strip of material is pulled manually, it tightens against the capsule thereby causing the capsule to burst.

Figure 4:
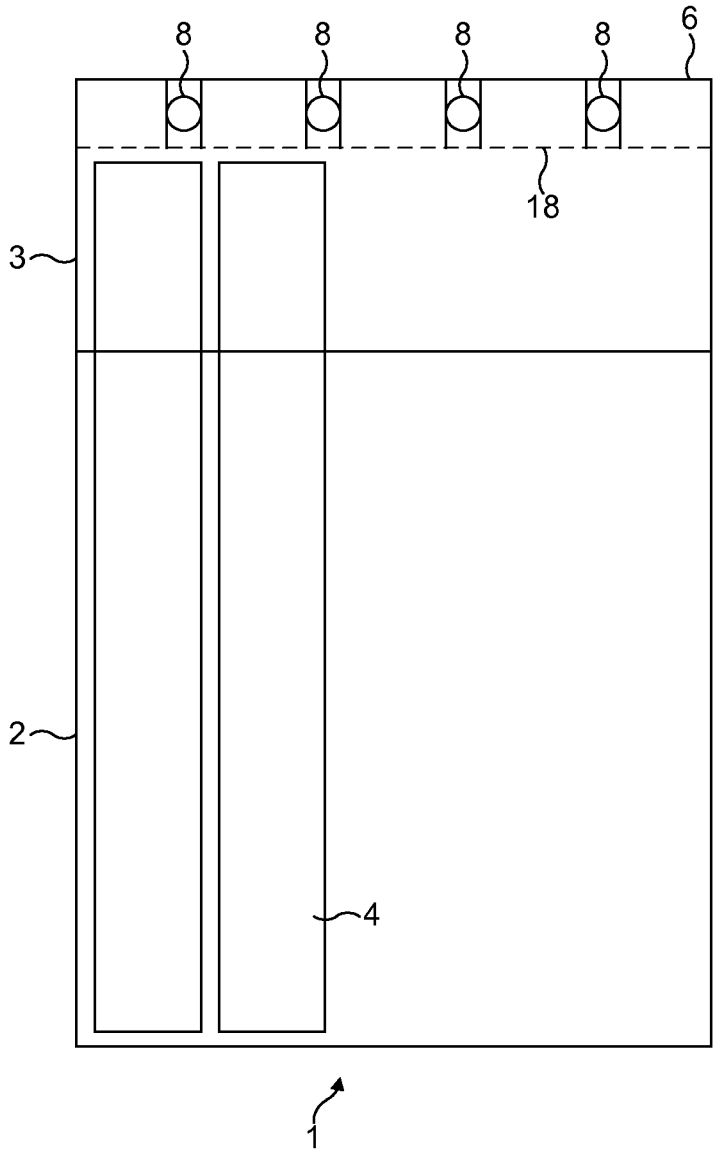
FIG. 4 is a schematic cross-sectional view of a further alternative embodiment of the pack.

A further embodiment is shown in FIG. 4, where a plurality of capsules 8 are disposed in discreet location in the lid portion 3 of the tobacco industry product pack 1, four such capsules being illustrated by way of example. Each of the capsules can be burst individually by pinching the appropriate location of the package lid between a user's thumb and forefinger. In this case, the lid is opened in order to allow access to the appropriate locations containing the capsules. This embodiment allows the user to burst a selected number of capsules at a given time to enhance the flavouring levels of the product disposed within the pack to a desirable level. For instance, if the user wishes to enhance the flavouring level associated with the product during consumption above that normally supplied by the manufacturer, then he might burst all, or a majority of the capsules in the lid, close the lid and wait for an appropriate time in which the flavouring material is absorbed by the product. Alternatively, if the product has become stale over time then the user might wish to refresh the flavouring levels of the product. In this instance, the user might burst only one or two of the capsules available in the lid. The position of the capsules in the lid can be indicated by an appropriately printed legend on the top surface 6 of the lid.

Figure 5A:
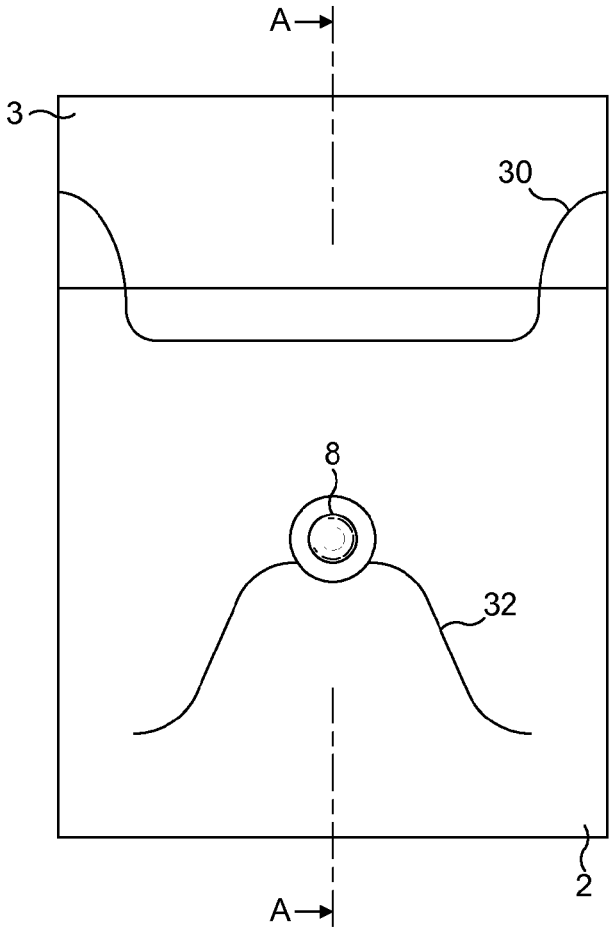
FIG. 5A is a front view of the pack and FIG. 5B is a cross-sectional view of the pack.
Figure 5B:
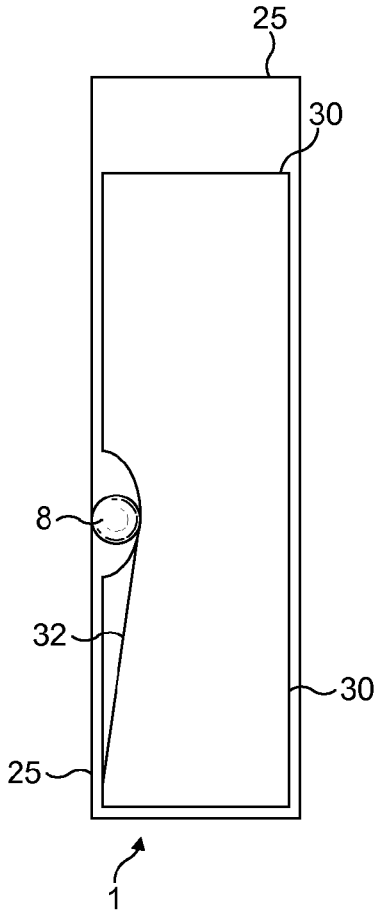

FIG. 5 shows another alternative embodiment where the capsule 8 is disposed between an outer shell 25 of the pack 1 and an inner frame 30. FIG. 5A shows the embodiment in plan view and FIG. 5B shows a cross-section of the embodiment along line AA. Typically, the inner frame is made from card which is permeable to moisture. In this embodiment, the capsule 8 is in fluid communication with the inner frame, such that when the capsule is burst and the flavouring substance disposed in the capsule is free to escape the capsule, the flavouring becomes absorbed by the inner frame. As a result, the concentration of the flavouring within the frame body is relatively evenly distributed so that flavouring material can be absorbed by products at a given rate, relatively independent to their position within the pack.

In addition, channels 32 between the inner frame and outer shell can be provided to distribute the flavouring liquid more evenly throughout the pack. These channels can comprise grooves disposed in the inner frame, in the outer shell, or both. The grooves might be constructed by creasing the inner frame, or by providing a de-bossed region in the inner frame, or outer shell. When released from the capsule, the flavouring fluid can flow along the grooves and become distributed at a relatively fast rate within the inner shell.

The tobacco industry products contained in the pack may comprise filter-tipped cigarettes. In this case, flavouring substances can be directed away from the filters to reduce the likelihood of contamination of the filters with flavouring. Thus, the channels of the embodiment shown in FIG. 5 can be arranged to distribute flavouring substances to the ends of the tobacco industry products which are not held in the user's mouth during consumption.

The present invention has been described above by way of example with reference to the enhancement of flavouring substances in tobacco industry products, which includes menthol and other flavours. However, the present invention can also be applied to the distribution of other aromatic products, water or humectants which may be used to refresh dry and stale products without additional flavouring of the product.

Other embodiments of the present invention will be envisaged by the skilled person without departing from the scope of the invention as defined in the claims.

The invention claimed is:

1. A pack for tobacco industry products, comprising:

a housing defining an enclosure configured to accommodate a plurality of tobacco industry products;

a carrier disposed in or on the pack, said carrier being arranged to accommodate a substance for altering characteristics of tobacco industry products;

a wick configured to provide fluid communication between the carrier and the enclosure;

an outer shell and an inner frame, the carrier disposed therebetween; and channels defined between the outer shell and the inner frame, the channels configured to direct the substance from the carrier;

wherein said carrier is configured to be manually operable to release a substance accommodated therein such that, when released, the substance is transported by the wick to a location in the enclosure for absorption by tobacco industry products when disposed in the pack.

2. The pack according to claim 1, wherein the wick comprises a portion of the housing.

3. The pack according to claim 2, wherein the wick is disposed to direct the substance released from the carrier to a predetermined portion of the enclosure.

4. The pack according to claim 3, wherein tobacco industry products are contained in the pack that comprise filter tipped smoking articles, and the predetermined portion of the enclosure is disposed distal from the end of the filters.

5. The pack according to claim 1, wherein the housing comprises an indentation accommodating the carrier.

6. The pack according to claim 1, wherein the carrier is attached to the pack by a covering member, said covering member being impermeable to the substance accommodated in the carrier.

7. The pack according to claim 1, wherein the carrier comprises a capsule containing the substance.

8. The pack according to claim 7, wherein one or more capsules are disposed in a lid portion of the pack.

9. The pack according to claim 8, wherein the capsules are accessible when the lid is in an open position to allow removal of a tobacco industry product from the pack.

10. The pack according to claim 7, further comprising a bursting mechanism that bursts the capsule for release of the substance therefrom.

11. The pack according to claim 10, wherein the bursting mechanism comprises a rod slideably disposed in a channel, the rod being moveable between a first position disengaged from the capsule and a bursting position.

12. The pack according to claim 10, wherein the bursting mechanism comprises two moveable rods arranged to burst a capsule disposed therebetween when the rods are moved towards one another.

13. The pack according to claim 1, wherein the channels comprise de-bossed sections of the inner frame or the outer shell.

14. The pack according to claim 13, wherein the channels are formed on respective surfaces of the inner frame or the outer shell, which face one another.

15. The pack according to claim 1, wherein the substance accommodated in the carrier comprises a flavouring substance, or a substance to refresh dry and stale products without additional flavouring thereof.

16. The pack according to claim 15, wherein the substance accommodated in the carrier is menthol.

17. The pack according to claim 15, wherein the substance accommodated in the carrier is water.

18. The pack according to claim 1, further comprising smoking articles.

* * * * *